US010088785B2

(12) United States Patent
Yamaguchi

(10) Patent No.: US 10,088,785 B2
(45) Date of Patent: Oct. 2, 2018

(54) IMAGE HEATING DEVICE

(71) Applicant: CANON KABUSHIKI KAISHA, Tokyo (JP)

(72) Inventor: Atsuhiko Yamaguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 143 days.

(21) Appl. No.: 14/716,542

(22) Filed: May 19, 2015

(65) Prior Publication Data

US 2015/0338795 A1 Nov. 26, 2015

(30) Foreign Application Priority Data

May 21, 2014 (JP) ..... 2014-105353

(51) Int. Cl.

| | |
|---|---|
| ***G03G 15/02*** | (2006.01) |
| ***G03G 15/20*** | (2006.01) |
| ***H05B 3/00*** | (2006.01) |
| ***H05B 1/02*** | (2006.01) |
| ***H05B 3/14*** | (2006.01) |
| ***H05B 6/10*** | (2006.01) |

(52) U.S. Cl.

CPC ..... *G03G 15/206* (2013.01); *G03G 15/2053* (2013.01); *H05B 1/0241* (2013.01); *H05B 3/0095* (2013.01); *H05B 3/141* (2013.01); *H05B 6/107* (2013.01)

(58) Field of Classification Search

CPC ..... G03G 15/206; G03G 15/2035; G03G 15/2014; G03G 15/2064; G03G 2215/2016; G03G 2215/2035; G03G 2215/2041; H05B 3/0095; H05B 3/141; H05B 1/0241; H05B 6/107

USPC ..... 219/216, 542; 399/329, 67, 122, 320

See application file for complete search history.

(56) References Cited

U.S. PATENT DOCUMENTS

2007/0278203 A1* 12/2007 Creteau ..... H05B 3/0095 219/216
2011/0123238 A1* 5/2011 Kimura ..... G03G 15/2064 399/320
2012/0063823 A1* 3/2012 Ando ..... G03G 15/206 399/328
2012/0076555 A1* 3/2012 Ikegami ..... G03G 15/206 399/328

(Continued)

FOREIGN PATENT DOCUMENTS

CN 1577163 A 2/2005
JP 11-084919 A 3/1999

(Continued)

*Primary Examiner* — Dana Ross
*Assistant Examiner* — Joe E Mills, Jr.
(74) *Attorney, Agent, or Firm* — Canon U.S.A., Inc. IP Division

(57) ABSTRACT

An image heating device is provided with a tubular film, and a unit placed inside the film. The unit includes a heater in contact with an inner surface of the film, a supporting member supporting the heater, and a highly thermal conductive member. The highly thermal conductive member placed between the heater and the supporting member and in contact with the heater. The unit is configured such that when the unit is viewed from a side where a surface of the heater is in contact with the film, at least a portion of the highly thermal conductive member is visible without being hidden behind the heater.

9 Claims, 10 Drawing Sheets

(56) References Cited

U.S. PATENT DOCUMENTS

2012/0121306 A1* 5/2012 Shimura ..... H05B 3/0095 399/329
2012/0148273 A1* 6/2012 Shimura ..... G03G 15/2039 399/33
2012/0269562 A1* 10/2012 Hashimoto ..... G03G 15/2017 399/338
2012/0308252 A1* 12/2012 Shimura ..... G03G 15/2039 399/67
2012/0308280 A1* 12/2012 Tsuruya ..... G03G 15/2042 399/329
2013/0026154 A1* 1/2013 Taniguchi ..... G03G 15/2053 219/385
2013/0034361 A1* 2/2013 Shinagawa ..... G03G 15/2053 399/67
2013/0051826 A1* 2/2013 Chiyoda ..... G03G 15/2046 399/45
2013/0051830 A1* 2/2013 Tamaki ..... G03G 15/2064 399/69
2013/0051831 A1* 2/2013 Shinagawa ..... G03G 15/2032 399/69
2013/0078016 A1* 3/2013 Koyama ..... G03G 15/2003 399/328
2013/0108298 A1* 5/2013 Chiyoda ..... G03G 15/2028 399/69
2013/0108306 A1* 5/2013 Saito ..... G03G 15/2053 399/90
2013/0108337 A1* 5/2013 Tamura ..... G03G 15/2053 399/328
2013/0121737 A1* 5/2013 Keino ..... G03G 15/2017 399/329
2013/0343790 A1* 12/2013 Shimura ..... G03G 15/2053 399/329
2013/0343791 A1* 12/2013 Shimura ..... G03G 15/2053 399/329
2014/0161499 A1* 6/2014 Ueda ..... G03G 15/206 399/329

FOREIGN PATENT DOCUMENTS

JP 2000-206809 A 7/2000
JP 2003-007435 A 1/2003
JP 2003-257592 A 9/2003
JP 2003-317898 A 11/2003
JP 2004-252301 A 9/2004
JP 2008-216741 A 9/2008
JP 2008-218267 A 9/2008
JP 2014-102429 A 6/2014
JP 2015-219498 A 12/2015

* cited by examiner

IMAGE HEATING DEVICE

BACKGROUND OF THE INVENTION

Field of the Invention

The present invention relates to an image heating device such as a fixing device mounted on an image forming apparatus such as an electrophotographic copying machine or an electrophotographic printer.

Description of the Related Art

On an image forming apparatus such as a copying machine or a printer using an electrophotographic method, a heating fixing device is mounted, which heats a recording medium (hereinafter referred to as a "recording sheet") on the surface of which an unfixed toner image has been formed, thereby fixing the unfixed toner image onto the recording sheet.

In the image forming apparatus, when recording sheets (small-size sheets) have widths smaller than that of a recording sheet having the maximum width size that can be used in the image forming apparatus, and if the small-size sheets are continuously passed through the image forming apparatus, and printed, a so-called temperature rise in a sheet non-passing portion occurs in which the temperature rises excessively in the area of the fixing device through which the small-size sheets do not pass.

As one of the techniques for addressing this problem, Japanese Patent Application Laid-Open No. 2003-317898 discusses a method for sandwiching a highly thermal conductive member between a heater and a supporting member of the heater.

If, however, the heater is attached to the supporting member when an apparatus is manufactured, the highly thermal conductive member is hidden behind the heater. Thus, even if the attachment of the highly thermal conductive member has been neglected, the neglect of the attachment may not be noticed.

Further, to sufficiently bring out the effect of the highly thermal conductive member, it is necessary to properly attach the highly thermal conductive member between the heater and the supporting member. However, particularly if a thin highly thermal conductive member such as a graphite sheet (the thickness of a graphite sheet is about 20 to 400 μm) is used, the sheet may be folded due to the thinness and the highly thermal conductive member may not be able to be properly attached when an apparatus is manufactured.

SUMMARY OF THE INVENTION

The present invention is directed to an image heating device capable of facilitating the confirmation of whether the attachment of a highly thermal conductive member has been neglected.

The present invention is also directed to an image heating device capable of facilitating the confirmation of whether a highly thermal conductive member of the image heating device is appropriately attached.

According to an aspect of the present invention, an image heating device includes a tubular film, and a unit arranged inside the tubular film and elongated in a generatrix direction of the film, the unit including a heater in contact with an inner surface of the film and elongated in the generatrix direction, the heater including a substrate and a heat generating member provided on the substrate, a supporting member supporting the heater, and a highly thermal conductive member having a thermal conductivity higher than a thermal conductivity of the substrate of the heater at least in a planar direction of the highly thermal conductive member, the highly thermal conductive member being arranged between the heater and the supporting member to be in contact with the heater, wherein a recording material on which an image has been formed is heated by heat of the heater via the film, and wherein the unit is configured so when the unit is viewed from a side where a surface of the heater is in contact with the film, at least a portion of the highly thermal conductive member is visible without being hidden behind the heater.

According to another aspect of the present invention, an image heating device includes a tubular film, and a unit arranged inside the tubular film and elongated in a generatrix direction of the film, the unit including a heater in contact with an inner surface of the film and elongated in the generatrix direction, the heater including a substrate and a heat generating member provided on the substrate, a supporting member supporting the heater, and a highly thermal conductive member having a thermal conductivity higher than a thermal conductivity of the substrate of the heater at least in a planar direction of the highly thermal conductive member, the highly thermal conductive member being arranged between the heater and the supporting member and in contact with the heater, wherein a recording material on which an image has been formed is heated by heat of the heater via the film, and wherein the highly thermal conductive member includes, in part of the highly thermal conductive member in a longitudinal direction of the heater, a protruding portion protruding further in a short direction of the heater, which is orthogonal to both the longitudinal direction of the heater and a thickness direction of the heater, than another portion of the highly thermal conductive member in the longitudinal direction.

Further features of the present invention will become apparent from the following description of exemplary embodiments with reference to the attached drawings.

DESCRIPTION OF THE EMBODIMENTS (1) Image Forming Unit

Figure 4:
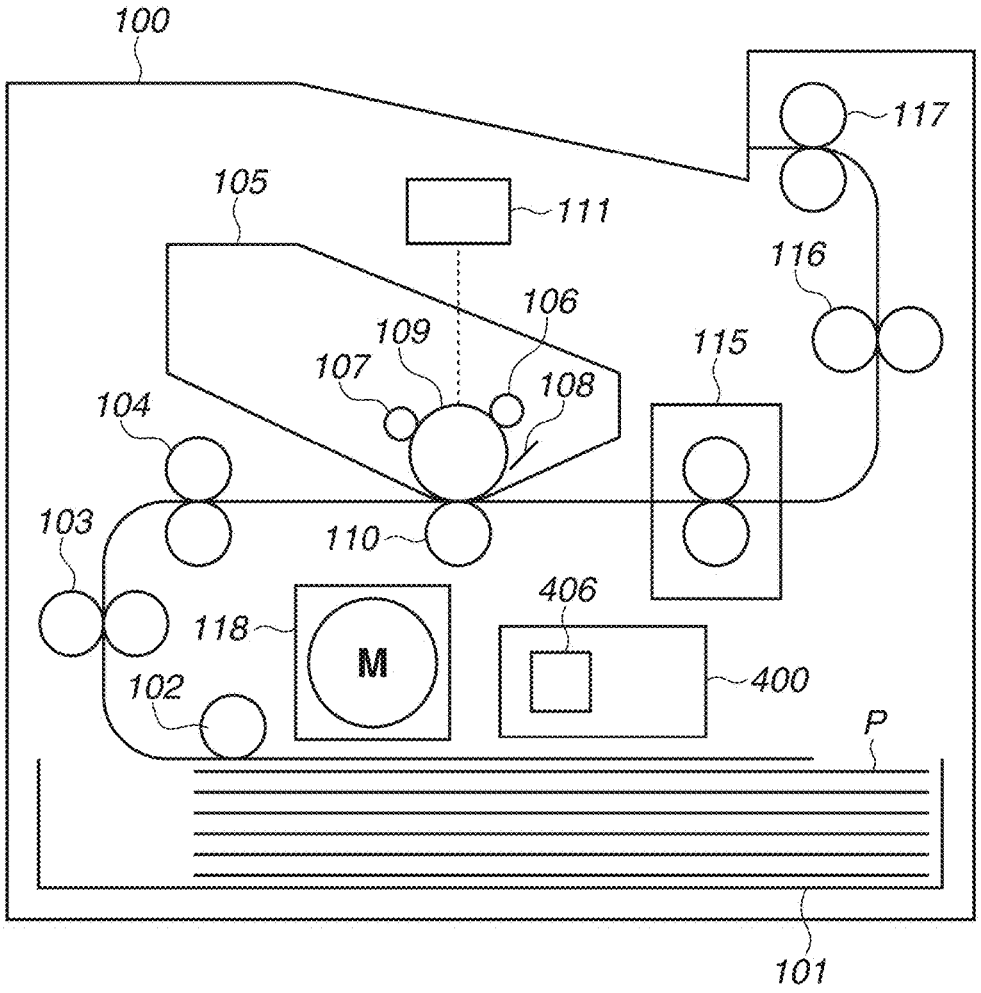
FIG. 4 is a diagram illustrating an image forming apparatus.

FIG. 4 is a schematic diagram illustrating a general configuration of an image forming apparatus 100. A recording material (hereinafter referred to as a "recording sheet" or a "sheet") P, which is stacked in a sheet feeding cassette 101, is conveyed to a process cartridge 105 at a predetermined timing via a pickup roller 102, sheet feeding rollers 103, and registration rollers 104.

The process cartridge 105 accommodates a charging unit 106, a development unit 107, a cleaning unit 108, and a photosensitive drum 109. Then, a known electrophotographic process is performed using laser light emitted from an image exposure unit 111 and using toner in the development unit 107, thereby forming an unfixed toner image on the photosensitive drum 109.

If the unfixed toner image on the photosensitive drum 109 has been transferred onto the recording sheet P by a transfer unit 110, the recording sheet P is subjected to a heating and pressurization process by a fixing unit (image heating device) 115, thereby fixing the unfixed toner image onto the recording sheet P. Then, the recording sheet P is discharged to outside the main body of the image forming apparatus 100 through intermediate sheet discharge rollers 116 and sheet discharge rollers 117. Thus, a series of printing operations is finished. A motor 118 imparts driving forces to all units including the image heating device 115. Further, the image heating device 115 is controlled by a ceramic heater driving circuit 400 and a central processing unit (CPU) 406.

The image forming apparatus 100 according to a first exemplary embodiment can deal with sheets of a plurality of sheet sizes. More specifically, the image forming apparatus 100 can print sheets of a plurality of sheet sizes set in the sheet feeding cassette 101, including a letter sheet (about 216 mm×279 mm), an A4 sheet (210 mm×297 mm), and an A5 sheet (148 mm×210 mm). Among printable standard recording material sizes (printable sheet sizes listed in a catalog), the letter sheet (a width of about 216 mm) has the largest size (the largest width). Sheets (the A4 sheet and the A5 sheet) having widths smaller than the maximum size printable by the image forming apparatus 100 (the maximum width size that can be used in the apparatus) are defined as small-size sheets in the present exemplary embodiment.

(2) Fixing Device (Image Heating Device)

(2-1) Overall Configuration of Device

Figure 5:
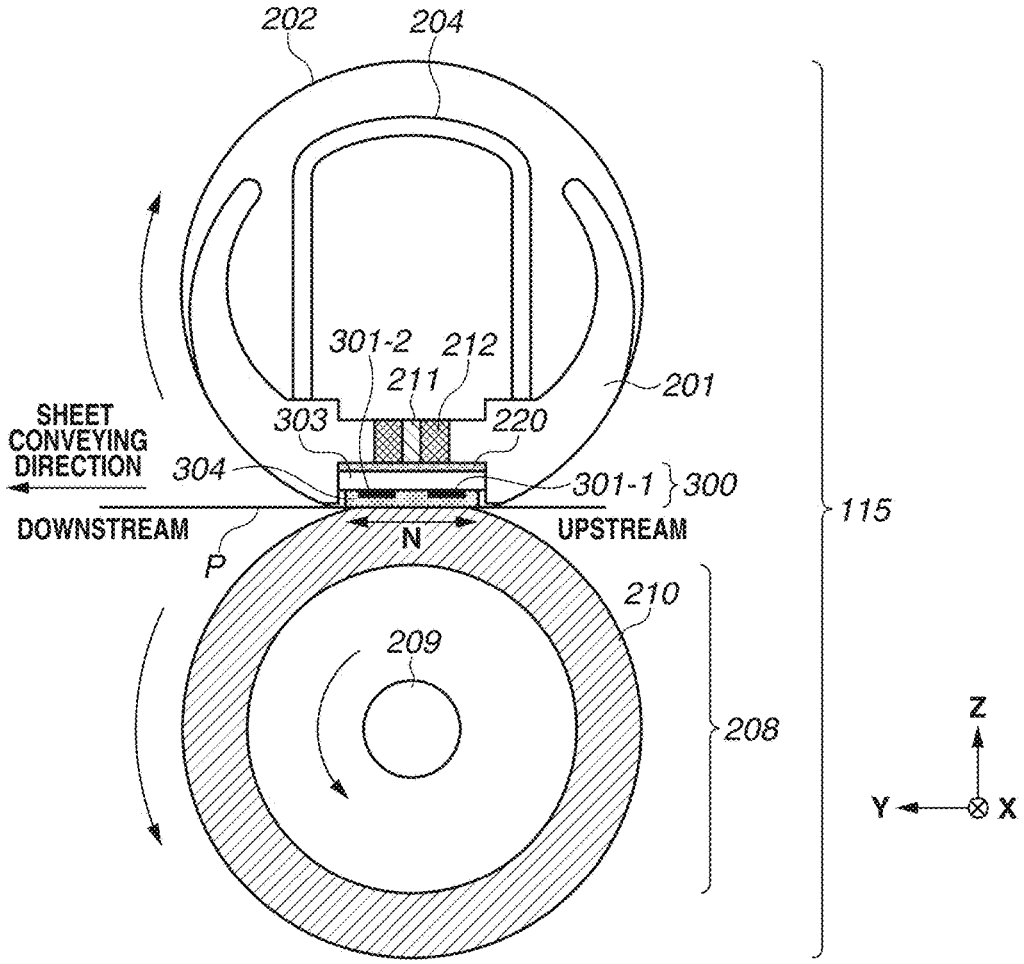
FIG. 5 is a diagram illustrating an image heating device.

FIG. 5 is a schematic diagram illustrating a transverse cross section of the main portion of the fixing device 115 mounted on the image forming apparatus 100. The fixing device 115 includes a tubular film (movable member) 202, a heater (heating member) 300, which is in contact with the inner surface of the film 202, and a pressure roller (nip portion formation member) 208, which forms a fixing nip portion N with the heater 300 through the film 202. The material of the base layer of the film 202 is a heat-resistant resin such as polyimide, or a metal such as stainless. The pressure roller 208 includes a metal core 209, the material of which is iron or aluminum, and an elastic layer 210, the material of which is silicone rubber.

The heater 300 is held in a heater supporting member (heating member supporting member) 201, which is made of a heat-resistant resin. The heater supporting member 201 also has a guiding function for guiding the rotation of the film 202. The pressure roller 208 receives the driving force from the motor 118 to rotate in the direction of arrows. The rotation of the pressure roller 208 drives the film 202 to rotate. A stay 204, which is made of a metal, applies the pressure of a spring (not illustrated) to the heater supporting member 201.

The heater 300 is a so-called ceramic heater that is long as a longitudinal direction of the ceramic heater in a direction (X-axis direction) orthogonal to the sheet conveying direction in the surface of the conveying path of the recording sheet P. The heater 300 includes a heater substrate 303, which is made of ceramic. The heater 300 also includes a resistance heating element (heat generating member) 301-1, which is provided on the heater substrate 303 along the longitudinal direction of the substrate 303, and a resistance heating element 301-2, which is provided along the longitudinal direction of the substrate 303 at a position different from that of the resistance heating element 301-1 in the width direction of the substrate 303. The heater 300 also includes a surface protection layer 304, which has insulation properties (made of glass in the present exemplary embodiment) and covers the resistance heating elements 301-1 and 301-2.

In the heater 300, the surface protection layer 304 side is a sheet passing surface side (a heater surface side). In the nip portion N, the inner surface of the film 202 slides in contact with the protection layer 304.

A highly thermal conductive member 220 is provided between the heater supporting member 201 and the heater 300. The highly thermal conductive member 220 is a member, the material of which has a thermal conductivity higher than that of the heater substrate 303 at least in the planar direction (X-axis direction and/or Y-axis direction) of the highly thermal conductive member 220. Examples of the highly thermal conductive member 220 include a graphite sheet. Alternatively, a thin metal plate made of aluminum may be used as the highly thermal conductive member 220. As described above, the fixing device (image heating device) 115 includes the tubular film 202 and a unit 500, which is placed inside the film 202 and long in the generatrix direction of the film 202 (the X-axis direction). The unit 500 is in contact with the inner surface of the film 202 and includes the heater 300, which is long in the generatrix direction of the film 202, the supporting member 201, which supports the heater 300, and the highly thermal conductive member 220, which has a thermal conductivity higher than that of the substrate 303 of the heater 300 at least in the planar direction of the highly thermal conductive member 220.

A thermistor (temperature detection element) 211 is in contact with the highly thermal conductive member 220. Further, a protection element 212, such as a thermal switch or a thermal fuse, also is in contact with the highly thermal conductive member 220. When the temperature of the heater 300 has abnormally risen, the protection element 212 operates to disconnect a power supplying line for the heater 300.

The thermistor 211 and the protection element 212 are pressurized against the highly thermal conductive member 220 by a leaf spring (not illustrated). The recording sheet P that bears an unfixed toner image is heated in the fixing nip portion N while being nipped and conveyed, whereby the toner image is subjected to a fixing process.

(2-2) Heater Temperature Adjustment Control

Heater temperature adjustment control is described. Examples of the method for heater temperature adjustment control include wave-number control, phase control, and hybrid control (i.e., combination of the wave-number control and the phase control). The phase control is a method for switching the on-rate (the duty cycle) within the period of one half-wave of a commercial alternating-current waveform and is suitable for reducing flicker. On the other hand, the wave-number control is a method for turning on and off the heating elements 301-1 and 301-2 included in the heater 300 in units of half-waves of a commercial alternating-current waveform (a method for switching the on-rate (the duty cycle) within the period of a predetermined number of half-waves) and is suitable for reducing harmonic current distortion or reducing switching noise.

Further, in the hybrid control, some of a plurality of half-waves in one control cycle are subjected to the phase control, and the remaining half-waves are subjected to the wave-number control. Thus, the hybrid control can reduce the generation of harmonic current or switching noise as compared to the case where only the phase control is performed. Further, the hybrid control is a control method capable of reducing flicker as compared to the case where only the wave-number control is performed. Generally, the method for heater temperature adjustment control is fixed to any one of the above three control methods according to the voltage of a commercial alternating-current power supply or the state of generation of flicker.

Figure 6:
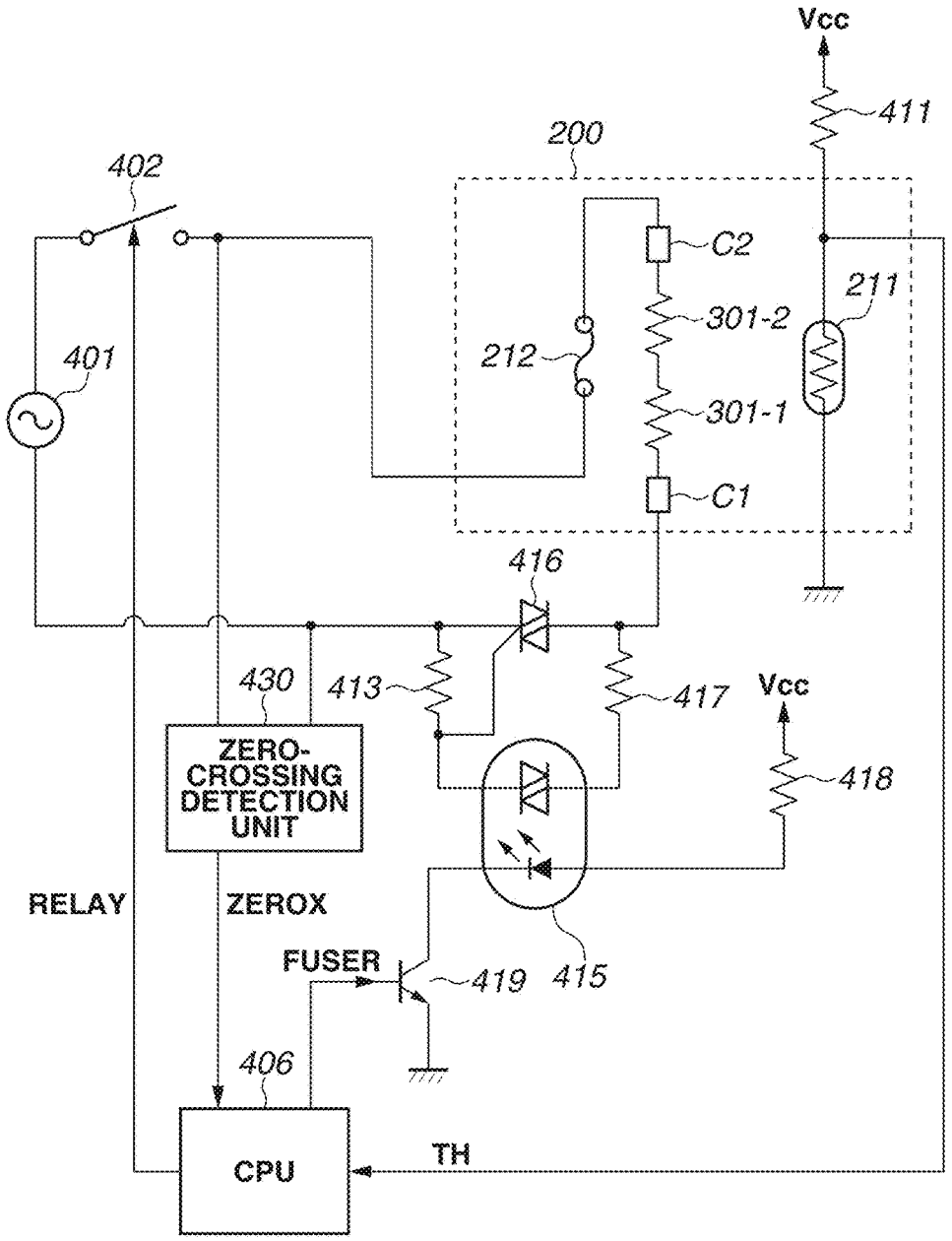
FIG. 6 is a diagram illustrating a control circuit of the heater.

FIG. 6 illustrates the ceramic heater driving circuit (i.e., power control unit) 400 of the heater 300 according to the present exemplary embodiment. The image forming apparatus 100 is connected to a commercial alternating-current power supply 401. Power to the heater 300 is controlled by applying or shutting off a current to a triode for alternating current (triac) 416. Power is supplied to the heater 300 via contact portions C1 and C2. Thus, power is supplied to the resistance heating elements 301-1 and 301-2 of the heater 300.

A zero-crossing detection unit 430 is a circuit for detecting the zero-crossing of the waveform of the alternating-current power supply 401 and outputs a ZEROX signal to the CPU 406. The ZEROX signal is used to control the heater 300. As an example of the zero-crossing circuit, a circuit discussed in Japanese Patent Application Laid-Open No. 2011-18027 can be used.

The operation of the triac 416 is described. Resistors 413 and 417 are current-limiting resistors for the triac 416. A phototriac coupler 415 is a device for securing the creepage distance between primary and secondary circuits. If a light-emitting diode of the phototriac coupler 415 emits light, the triac 416 is turned on. A resistor 418 is a resistor for limiting the current of the light-emitting diode of the phototriac coupler 415. A transistor 419 turns on and off the phototriac coupler 415. The transistor 419 operates according to a FUSER signal from the CPU 406.

A thermistor 211 is an element of which the resistance value changes according to the temperature. A TH signal corresponding to the voltage obtained by dividing a voltage Vcc with the resistance value of the thermistor 211 and the resistance value of a resistor 411 is input to the CPU 406. In other words, the TH signal corresponds to the temperature detected by the thermistor 211. In the internal processing of the CPU 406, power to be supplied is calculated by, for example, proportional-integral (PI) control based on the temperature detected by the thermistor 211 and the temperature set in the heater 300. Further, the CPU 406 calculates a control level (a phase angle in the case of the phase control, and a wave-number in the case of the wave-number control) corresponding to the power to be supplied, thereby controlling the triac 416.

If the fixing device 115 has entered a heat generation state beyond a steady state due to the failure of the power control unit 400 such as the short-circuiting of the triac 416, the protection element 212 operates to shut off the supply of power to the heater 300. Further, if the temperature detected by the thermistor 211 (the TH signal) is a predetermined temperature or above, a relay 402 is brought into a non-power application state, thereby shutting off the supply of power to the heater 300.

(2-3) Relational Configuration of Heater, Highly Thermal Conductive Member, and Heater Supporting Member FIGS. 1A and 1B to FIGS. 3A and 3B illustrate the relationships between the heater 300, the highly thermal conductive member 220, and the heater supporting member 201 in the present exemplary embodiment. FIGS. 1A and 1B to FIGS. 3A and 3B illustrate only the main portion of the heater supporting member 201 illustrated in FIG. 5 and omit the portions other than the main portion, such as a film guiding portion. In this example, a PGS graphite sheet (a thickness of 50 μm) manufactured by Panasonic Corporation is used as the highly thermal conductive member 220.

In the heater supporting member 201, a groove portion (recessed portion) 201A is provided, into which the highly thermal conductive member 220 and the heater 300 are inserted. When a device is assembled, the highly thermal conductive member 220 is inserted into the groove portion 201A, and then, the heater 300 is inserted into the groove portion 201A. Thus, the configuration is such that the highly thermal conductive member 220, which has a thermal conductivity higher than that of the substrate 303 of the heater 300 in the planar direction of the highly thermal conductive member 220, is placed between the heater supporting member 201 and the heater 300. The heater supporting member 201 includes heater supporting portions (first portions) 201-1, which regulate heater side surfaces 300*a* along the longitudinal direction of the heater 300 (the X-axis direction) on both sides in the width direction of the heater 300 (the Y-axis direction). The heater supporting member 201 also includes heater non-supporting portions (second portions) 201-2, which do not regulate the heater side surfaces 300*a*. In other words, in the supporting member 201, the first portions 201-1 are provided, which are surfaces forming the recessed portion 201A of the supporting member 201 and are close to or in contact with the heater side surfaces 300*a*, which are orthogonal to the short direction of the supporting member 201 (the Y-axis direction). Further, in the supporting member 201, the second portions 201-2 are provided, which are portions at positions different from those of the first portions 201-1 in the longitudinal direction of the supporting member 201 (the X-axis direction) and are further away from the heater side surfaces 300*a* than the first portions 201-1 are.

Figure 1A:
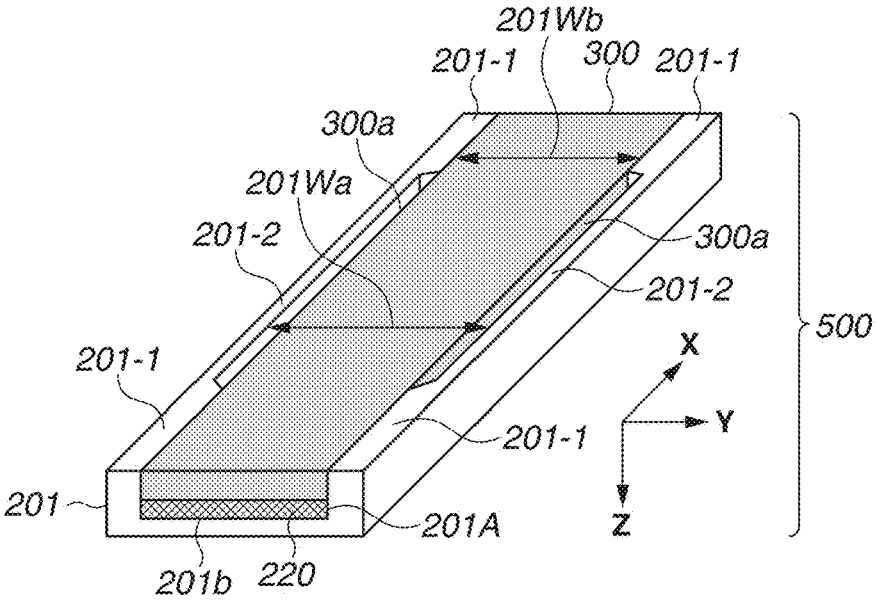
FIGS. 1A and 1B are diagrams illustrating configurations of a heater, a highly thermal conductive member, and a heater supporting member according to a first exemplary embodiment (part 1).
Figure 1B:
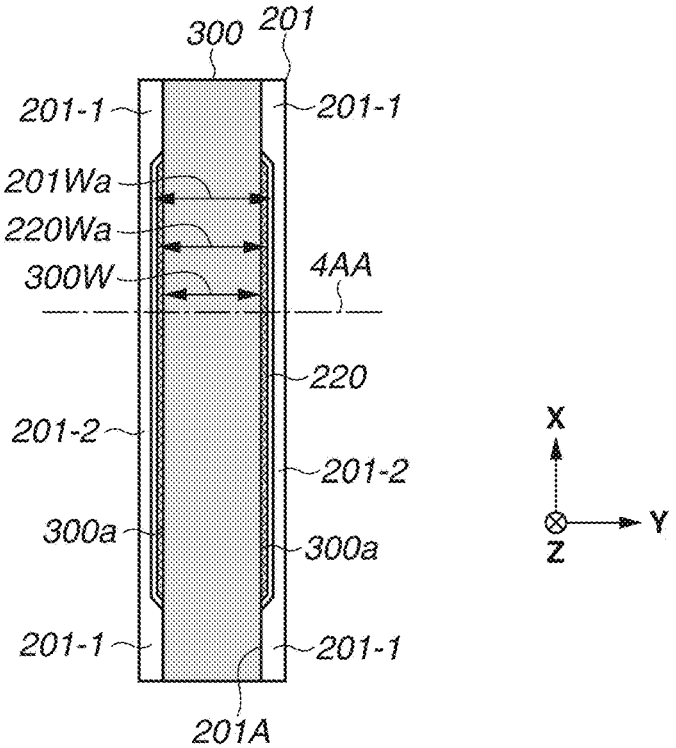
Figure 2A:
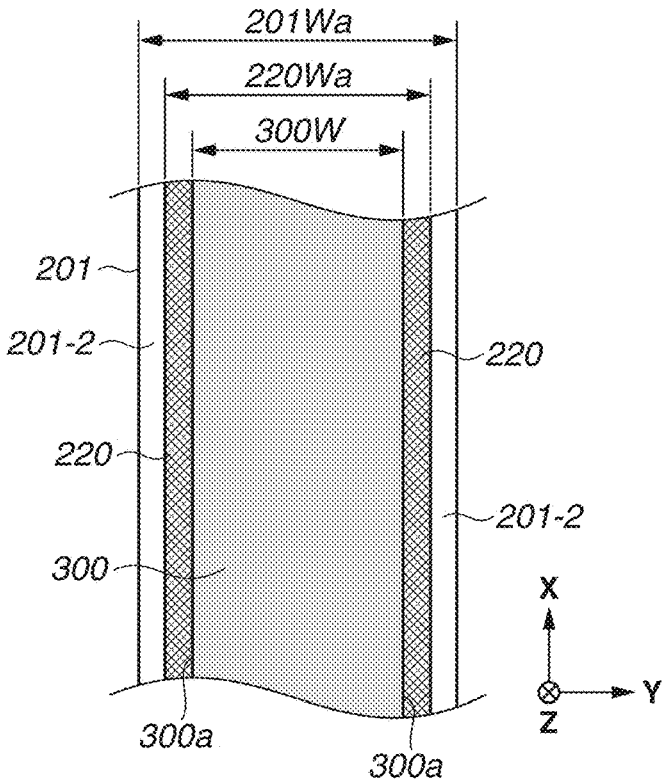
FIGS. 2A and 2B are diagrams illustrating configurations of the heater, the highly thermal conductive member, and the heater supporting member according to the first exemplary embodiment (part 2).
Figure 2B:
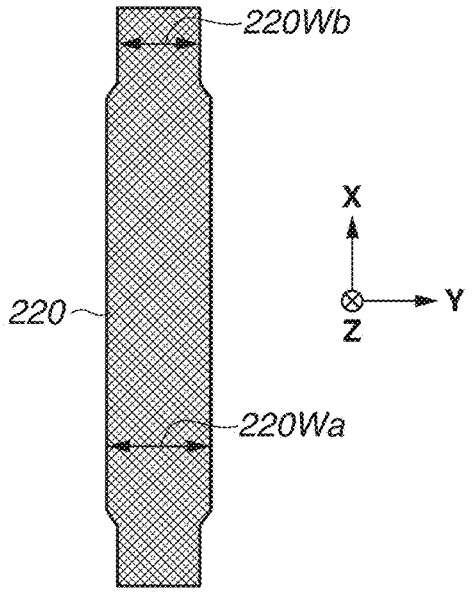

Although described later, as illustrated in FIG. 2B, the highly thermal conductive member 220 includes, in part of the highly thermal conductive member 220 in the longitudinal direction of the heater 300 (the X-axis direction), a protruding portion (a portion having a width 220Wa) protruding further in the short direction of the heater 300 (the Y-axis direction), which is orthogonal to both the longitudinal direction of the heater 300 (the X-axis direction) and the thickness direction of the heater 300 (the Z-axis direction), than another portion (a portion having a width 220Wb) of the highly thermal conductive member 220 in the longitudinal direction of the heater 300 (the X-axis direction). Then, the highly thermal conductive member 220 is arranged so the protruding portion of the highly thermal conductive member 220 is positioned in the second portions 201-2 of the supporting member 201.

Then, an opening portion between the portion 201-2 on one side and the portion 201-2 on the other side, which are opposed to each other in the Y-axis direction, has a width 201Wa. Further, the protruding portion of the highly thermal conductive member 220 has the width 220Wa. Further, the heater 300 has a width 300W. The relationships between these widths satisfy:

$$\text{width } 201\text{Wa} \geq \text{width } 220\text{Wa} > \text{width } 300\text{W} \quad (1)$$

A seating surface 201*b* of the groove portion 201A is a highly thermal conductive member attachment portion (an attachment seating surface portion).

In the present exemplary embodiment, the heater supporting portions 201-1 are provided in both end portions of the supporting member 201 in the longitudinal direction of the heater 300 (the X-axis direction). A width 201Wb of an opening portion between the heater supporting portion 201-1 on one side and the heater supporting portion 201-1 on the other side, which are opposed to each other in the Y-axis direction, is equivalent to the width 300W of the heater 300. The heater supporting portions 201-1 regulate the movement of the heater 300 in the Y-axis direction when the heater 300 is fit into the groove portion 201A.

Further, the width 220Wb of the highly thermal conductive member 220, which corresponds to the heater supporting portions 201-1, is equivalent to the width 300W of the heater 300. The width 220Wa of the highly thermal conductive member 220, which corresponds to the heater non-supporting portions 201-2, is greater than the width 300W of the heater 300 and equivalent to the width 201Wa of the opening portion. Thus, these widths satisfy the above formula (1).

In the present exemplary embodiment, the planar shape of the highly thermal conductive member 220 (FIG. 2B) almost matches the planar shape of the seating surface 201*b*, which is the highly thermal conductive member attachment portion in the groove portion 201A of the heater supporting member 201.

With the above configuration, it is possible to confirm the installation state of the highly thermal conductive member 220 in the portion of the heater non-supporting portions 201-2. More specifically, the unit 500 is configured so when the unit 500 is viewed from the side where the surface of the heater 300 is in contact with the film 202 (viewed in the Z-axis direction), at least a portion of the highly thermal conductive member 220 (the protruding portion having the width 220Wa in this example) is visible without being hidden behind the heater 300. FIG. 2A is a partial enlarged view of FIG. 1B. Thus, it is easy to confirm whether the attachment of the highly thermal conductive member 220 has been neglected. Further, it is possible to easily confirm that the highly thermal conductive member 220 is accurately sandwiched between the heater supporting member 201 and the heater 300. In other words, it is possible to easily confirm that the highly thermal conductive member 220 is properly attached without being folded, torn off, or bent. This can sufficiently provide the performance of the highly thermal conductive member 220.

FIG. 2B illustrates the planar shape of the highly thermal conductive member 220. The visible portion of the highly thermal conductive member 220 (the protruding portion having the width 220Wa) is a protruding portion protruding further in the short direction of the heater 300 (the Y-axis direction), which is orthogonal to both the longitudinal direction of the heater 300 (the X-axis direction) and the thickness direction of the heater 300 (the Z-axis direction), than another portion (the portion having the width 220Wb) of the highly thermal conductive member 220 in the longitudinal direction of the heater 300 (the X-axis direction). Thus, the dimensional relationships between these widths satisfy:

$$201\text{Wa} \geq 220\text{Wa} > 220\text{Wb} \quad (2)$$

Figure 3A:
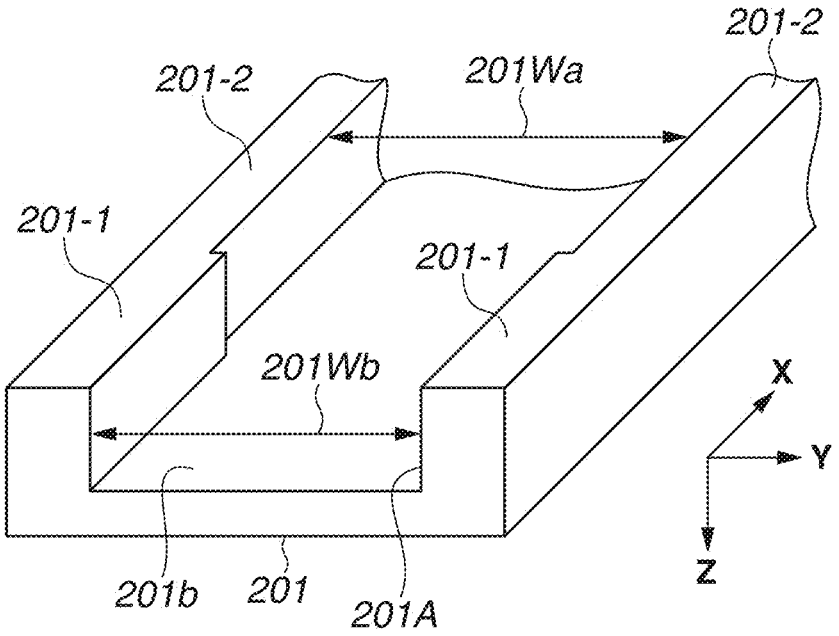
FIGS. 3A and 3B are diagrams illustrating configurations of the heater, the highly thermal conductive member, and the heater supporting member according to the first exemplary embodiment (part 3).
Figure 3B:
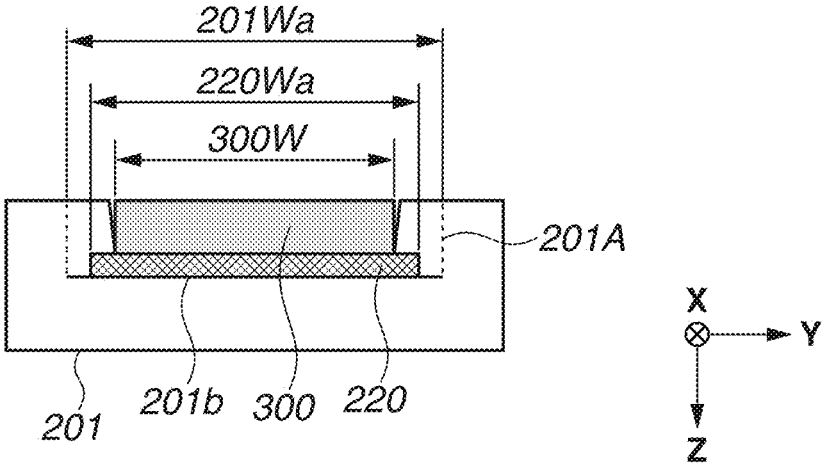

FIG. 3A illustrates a general configuration of the heater supporting member 201. The heights of both the heater supporting portions 201-1 and the heater non-supporting portions 201-2 from the seating surface 201*b* are uniform. FIG. 3B is an enlarged cross-sectional view along a line 4AA in FIG. 1B. The highly thermal conductive member 220 is attached along the seating surface 201*b* of the groove portion 201A and sandwiched between the heater 300 and the heater supporting member 201.

In a second exemplary embodiment, an example is described where the shape of the heater supporting member 201 is changed so that more heater supporting portions (first portions) are included than those in the first exemplary embodiment. The components similar to those of the first exemplary embodiment are designated by the same numerals and are not described here.

FIGS. 7A and 7B and FIGS. 8A and 8B illustrate configurations of the heater 300, the highly thermal conductive member 220, and the heater supporting member 201 according to the second exemplary embodiment. In the groove portion 201A of the heater supporting member 201, the highly thermal conductive member 220 is sandwiched between the heater 300 and the heater supporting member 201. The heater 300 is held by a plurality of heater supporting portions 201-1 and 201-3. Further, in the heater supporting member 201, a plurality of heater non-supporting portions 201-4, which are areas free from the heater 300, are present, and a plurality of opening portions, each having a width 201Wc, are provided.

Figure 7A:
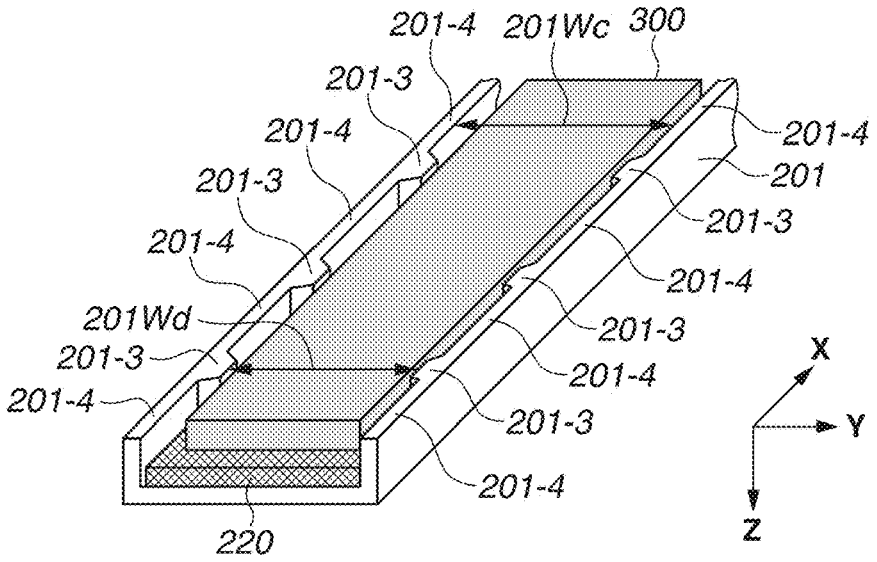
FIGS. 7A and 7B are diagrams illustrating a second exemplary embodiment (part 1).
Figure 7B:
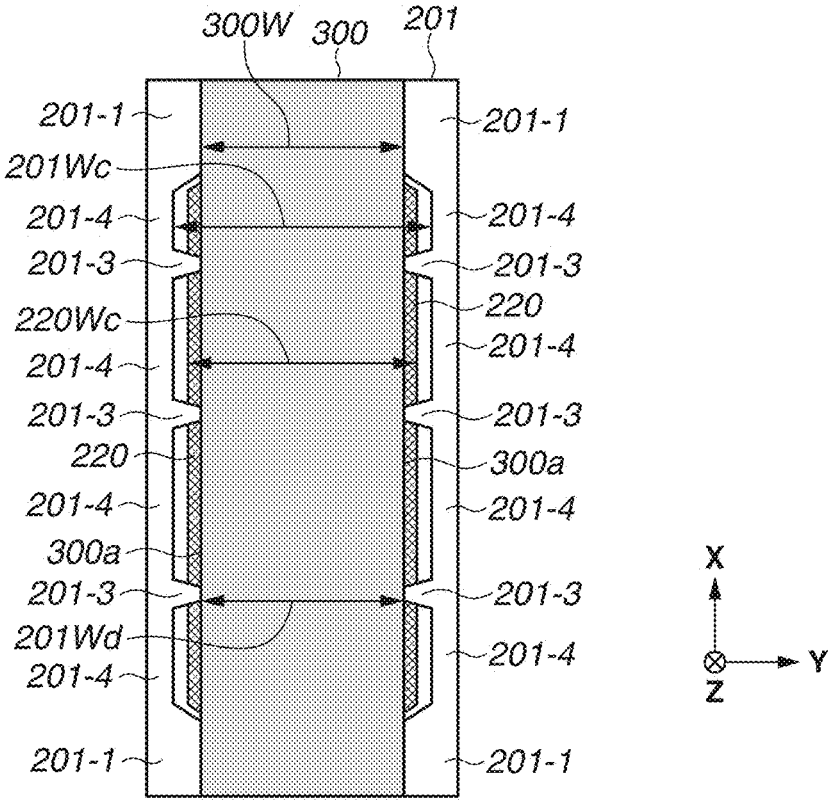

FIG. 7A illustrates a general configuration according to the present exemplary embodiment. Further, FIG. 7B illustrates size relationships between the heater 300, the highly thermal conductive member 220, and the heater supporting member 201. This structure allows the visual confirmation of the highly thermal conductive member 220 in the portions of the heater non-supporting portions 201-4 at a plurality of positions near the center in the X-axis direction.

The relationships between the width 201Wc of the opening portions corresponding to the heater non-supporting portions 201-4 of the groove portion 201A, a width 220Wc of the portions of the highly thermal conductive member 220 corresponding to the above opening portions for the heater 300, and a width 300W of the heater 300 satisfy:

$$201\text{Wc} \geq 220\text{Wc} > 300\text{W} \quad (3)$$

Figure 8A:
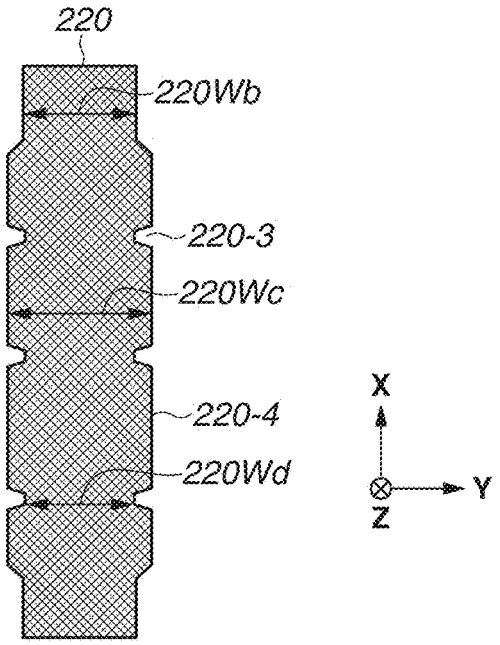
FIGS. 8A and 8B are diagrams illustrating the second exemplary embodiment (part 2).

FIG. 8A illustrates a shape of the highly thermal conductive member 220. The highly thermal conductive member 220 has a width 220Wb in portions corresponding to the heater supporting portions 201-1, the width 220Wc in portions corresponding to the heater non-supporting portions 201-4, and a width 220Wd in portions corresponding to the heater supporting portions 201-3. The dimensional relationships between these widths satisfy:

$$220\text{Wc} > 220\text{Wb} \geq 220\text{Wd} \quad (4)$$

Figure 8B:
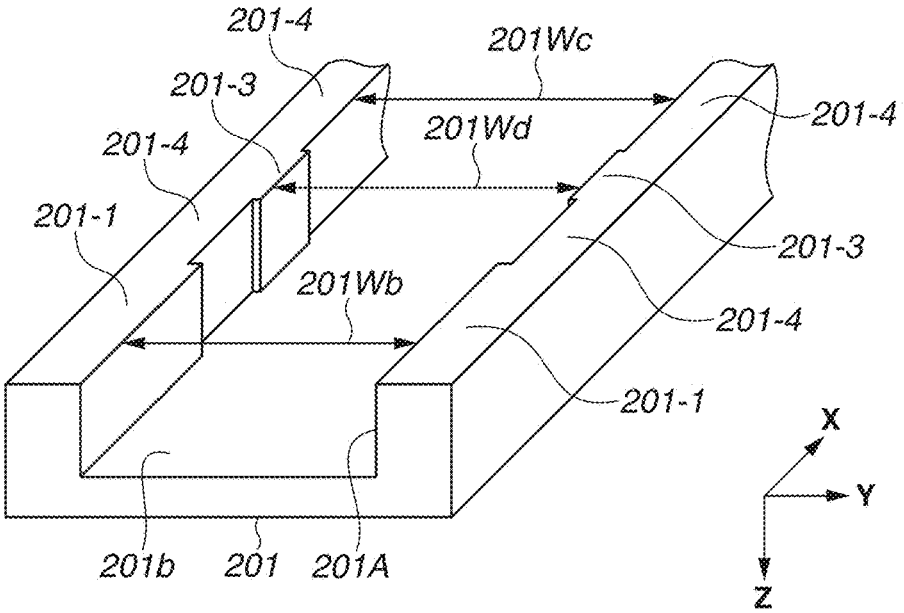

FIG. 8B illustrates a general configuration of the heater supporting member 201 according to the second exemplary embodiment. The heights of all the plurality of heater supporting portions 201-1 and 201-3 and the heater non-supporting portions 201-4 from the seating surface 201*b* are uniform.

As described above, the heater supporting member 201 in this example includes the plurality of heater supporting portions 201-3 and the plurality of heater non-supporting portions 201-4 in addition to the supporting portions 201-1. Heat is easily transferred from the heater 300 to the supporting portions. In the configuration in which the supporting portions 201-3 are not provided, if the temperature distribution in the longitudinal direction of the heater 300 cannot be made uniform, the supporting portions 201-3 are added as in this example. Thus, it is possible to configure a device capable of making the temperature distribution uniform.

In a third exemplary embodiment, an example is described where a positioning shape portion for the highly thermal conductive member 220 is provided on the seating surface 201*b*, which is the highly thermal conductive member attachment portion of the heater supporting member 201, thereby improving the accuracy of positioning. The components similar to those of the first and second exemplary embodiments are designated by the same numerals and are not described here.

FIGS. 9A and 9B and FIGS. 10A and 10B illustrate a general configuration according to the present exemplary embodiment. The present exemplary embodiment is different from the first and second exemplary embodiments in that in the groove portion 201A of the heater supporting member 201, a seating surface 201*c* for holding the highly thermal conductive member 220 and simultaneously determining the attachment position of the highly thermal conductive member 220 is provided in the seating surface 201*b*, which is the highly thermal conductive member attachment portion. The planar shape of the highly thermal conductive member 220 almost matches the shape of the seating surface 201*c*.

More specifically, the configuration is such that the seating surface 201*c*, which is more recessed than the seating surface 201*b*, is provided. The seating surface 201*c* is a seating surface for holding the highly thermal conductive member 220 in the heater supporting member 201 and simultaneously determining the attachment position of the highly thermal conductive member 220. The highly thermal conductive member 220 is arranged to match the seating surface 201*c*. The highly thermal conductive member 220 is not in contact with the seating surface 201*b* of the supporting member 201 in this example.

The highly thermal conductive member 220 and the heater 300 need to be securely in firm contact with each other. Thus, the relationship between a depth 201We of the seating surface 201*c* and a thickness 220We of the highly thermal conductive member 220 satisfies:

$$220We \geq 201We \quad (5)$$

Thus, the depth 201We of the seating surface 201*c* is less than or equal to the thickness 201We of the highly thermal conductive member 220.

Figure 9A:
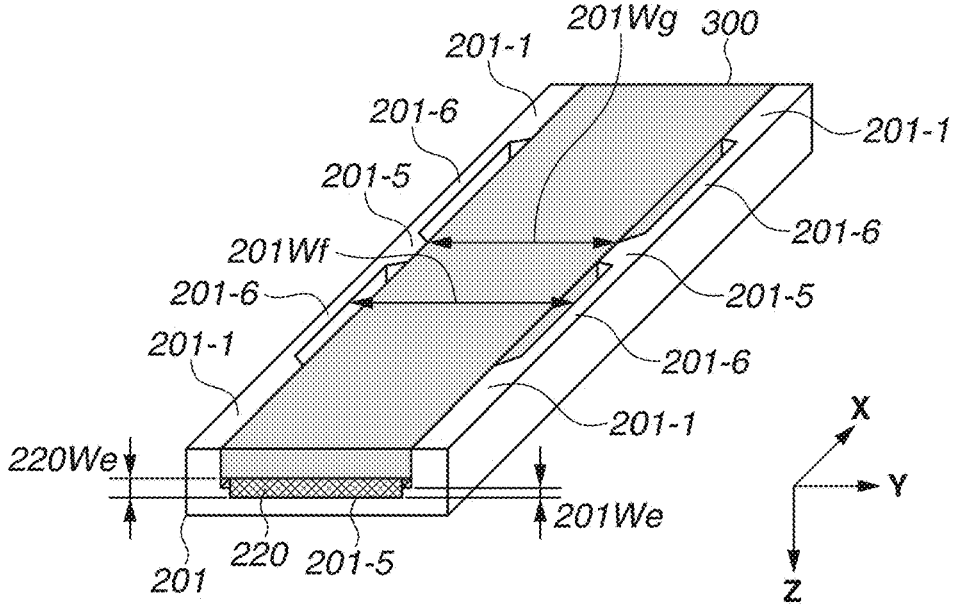
FIGS. 9A and 9B are diagrams illustrating a third exemplary embodiment (part 1).
Figure 9B:
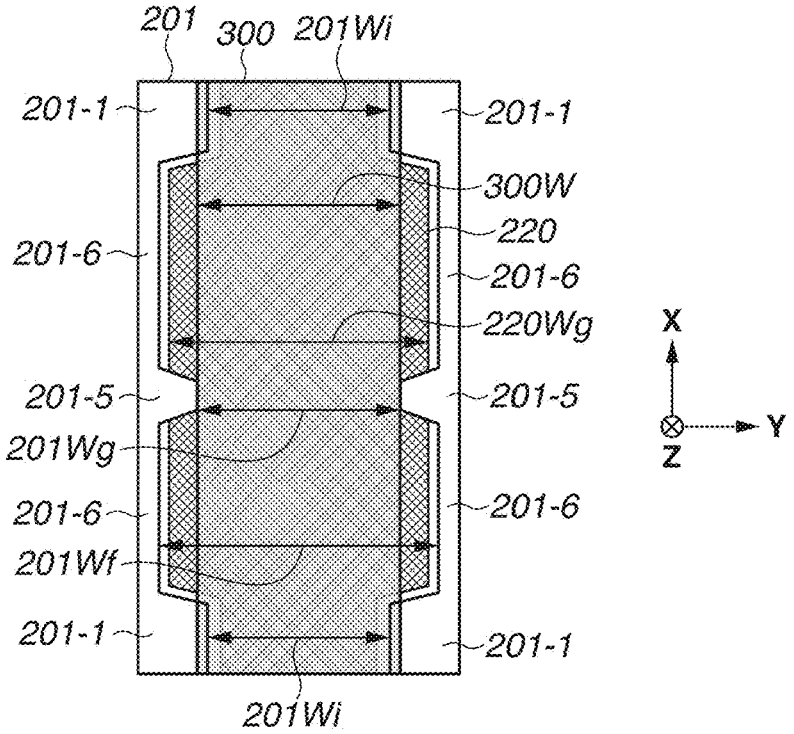
Figure 10A:
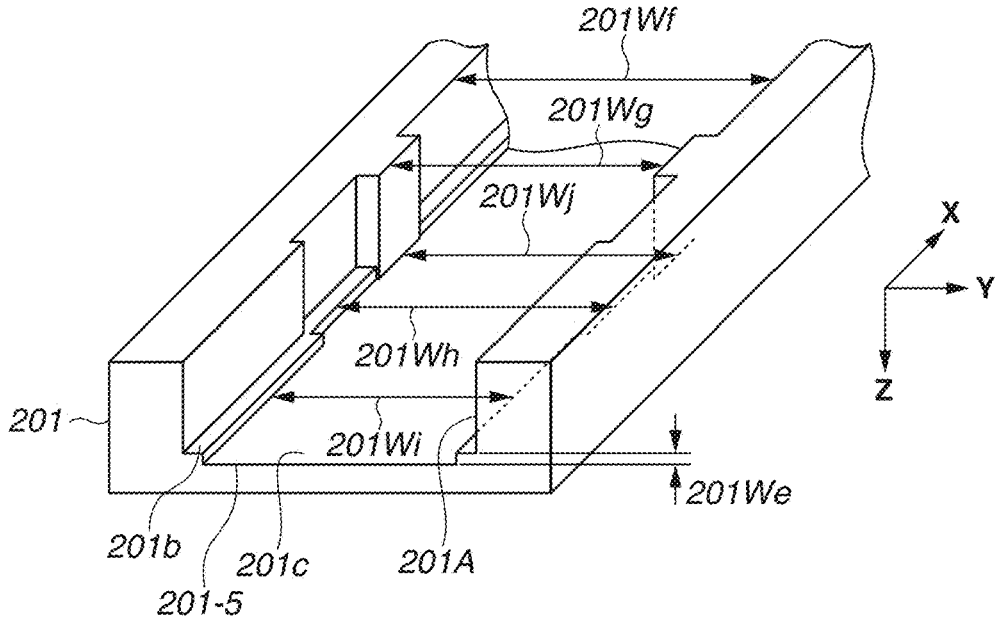
FIGS. 10A and 10B are diagrams illustrating the third exemplary embodiment (part 2).
Figure 10B:
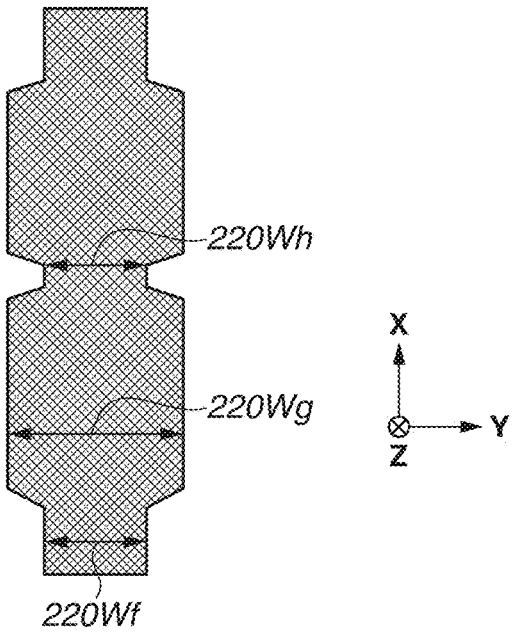

FIGS. 9B and 10B illustrate size relationships between the heater 300, the highly thermal conductive member 220, and the heater supporting member 201 at each position. At the positions of heater supporting portions 201-5, the dimensional relationships between the width 300W of the heater 300, a width 201Wj of the seating surface 201*c* in the Y-axis direction, and a width 220Wh of the highly thermal conductive member 220 satisfy:

$$300W > 201Wj \geq 220Wh \quad (6)$$

Further, at the positions of heater non-supporting portions 201-6, the dimensional relationships between a width 201Wh of the seating surface 201*c* in the Y-axis direction, a width 220Wg of the highly thermal conductive member 220, and the width 300W of the heater 300 satisfy:

$$201Wh \geq 220Wg > 300W \quad (7)$$

FIG. 10A illustrates a general configuration of the heater supporting member 201 according to the third exemplary embodiment. At the positions of the supporting portions 201-1 provided at both ends in the longitudinal direction of the supporting member 201, the seating surface 201*c* has a width 201Wi in the Y-axis direction. The highly thermal conductive member 220 has a width 220Wf at these positions. The relationship between these widths is set to 201Wi≥220Wf. At the positions of the non-supporting portions 201-6, the seating surface 201*c* has the width 201Wh in the Y-axis direction. The highly thermal conductive member 220 has the width 220Wg at these positions. The relationship between these widths is set to 201Wh≥220Wg. At the positions of the supporting portions 201-5, the seating surface 201*c* has the width 201Wj in the Y-axis direction. The highly thermal conductive member 220 has the width 220Wh at these positions. The relationship between these widths is set to 201Wj≥220Wh. The supporting member 201 has a width 201Wf in the Y-axis direction at the positions of the non-supporting portions 201-6 and at the height of the seating surface 201*b*. The relationship between the widths 201Wf and 201Wj is 201Wf>201Wh. The supporting member 201 has a width 201Wg in the Y-axis direction at the positions of the supporting portions 201-5 and at the height of the seating surface 201*b*. The relationship between the widths 201Wg and 201Wj is 201Wg≥201Wj.

As described above, in the heater supporting member 201, a seating surface used exclusively for attaching the highly thermal conductive member 220 is formed. With this configuration, it is possible to position the highly thermal conductive member 220 with high accuracy and also easily confirm that the highly thermal conductive member 220 is mounted in a proper state.

Other Exemplary Embodiments (1) The heater 300 is not limited to the ceramic heater in the exemplary embodiments. Alternatively, the heater 300 may be a heater in which Nichrome wire is disposed, or an induction heat generation member for generating heat by electromagnetic induction, using an exciting coil.

(2) The image heating device according to the present invention is not limited to usage as a fixing device as in the exemplary embodiments. The image heating device according to the present invention is also effective as an image property modification device that reheats a toner image once fixed or temporarily fixed onto a recording material to increase glossiness.

(3) The image forming unit of the image forming apparatus is not limited to that using an electrophotographic method. Alternatively, the image forming unit may be an image forming unit using an electrostatic recording method or a magnetic recording method. The image forming apparatus may form a toner image on a recording material using not only a transfer method but also a direct method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-105353, filed May 21, 2014, which is hereby incorporated by reference herein in its entirety.

What is claimed is:

1. An image heating device comprising:

a tubular film;

a unit arranged inside the tubular film and elongated in a longitudinal direction of the film, the unit including:

a heater having a plate-like shape and a first surface in contact with an inner surface of the film and elongated in the longitudinal direction, the heater including a substrate and a heat generating member provided on the substrate;

a supporting member supporting the heater; and a highly thermal conductive member having a thermal conductivity higher than that of the substrate of the heater at least in a planar direction of the highly thermal conductive member and including, in a part of the highly thermal conductive member in the longitudinal direction, a protruding portion protruding from a side surface of the heater orthogonal to the longitudinal direction, the highly thermal conductive member being arranged between the heater and the supporting member and being in contact with a second surface of the heater opposite to the first surface of the heater, wherein a recording material on which an image has been formed is heated by heat of the heater via the film, and wherein the unit is configured so that the protruding portion is visible from a gap between the supporting member and the heater when the unit is viewed in a direction orthogonal to the first surface of the heater.

2. The image heating device according to claim 1, wherein a width of the protruding portion of the highly thermal conductive member in a width direction of the heater orthogonal to the longitudinal direction is greater than a width of the heater in the width direction of the heater.

3. The image heating device according to claim 2, wherein the supporting member includes a recessed portion into which the heater and the highly thermal conductive member are inserted, the recessed portion including a first surface which faces the side surface of the heater and a second surface which faces the side surface of the heater, is provided adjacent to the first surface of the recessed portion in the longitudinal direction, and is further away from the side surface of the heater than the first surface of the recessed portion, and wherein when the unit is viewed, in the direction orthogonal to the first surface of the heater, from the side of the first surface of the heater, the protruding portion of the highly thermal conductive member is overlapped with the second surface of the supporting member in the longitudinal direction.

4. The image heating device according to claim 1, wherein the highly thermal conductive member is a graphite sheet.

5. An image heating device comprising:

a tubular film;

a unit arranged inside the tubular film and elongated in a longitudinal direction of the film, the unit comprising:

a heater having a plate-like shape and a first surface in contact with an inner surface of the film, the heater being elongated in the longitudinal direction, the heater including a substrate and a heat generating member provided on the substrate;

a supporting member supporting the heater; and a highly thermal conductive member having a thermal conductivity higher than that of the substrate of the heater at least in a planar direction of the highly thermal conductive member, the highly thermal conductive member being arranged between the heater and the supporting member and being in contact with a second surface of the heater opposite to the first surface of the heater, wherein a recording material on which an image has been formed is heated by heat of the heater via the film, and wherein the highly thermal conductive member includes a protruding portion protruding from a side surface of the heater orthogonal to the second surface, a length of the protruding portion of the highly thermal conductive member in the longitudinal direction being shorter than an entire length of the highly thermal conductive member in the longitudinal direction.

6. The image heating device according to claim 5, wherein a width of the protruding portion of the highly thermal conductive member in a width direction of the heater orthogonal to the longitudinal direction is greater than a width of the heater in the width direction.

7. The image heating device according to claim 6, wherein the supporting member includes a recessed portion into which the heater and the highly thermal conductive member are inserted, the supporting member including a first surface which faces the side surface of the heater and a second surface which faces the side surface of the heater, is provided adjacent to the first surface of the supporting member in the longitudinal direction, and is further away from the side surface of the heater than the first surface of the supporting member, and wherein when the unit is viewed, in the direction orthogonal to the first surface of the heater, from the side of the first surface of the heater, the protruding portion of the highly thermal conductive member is overlapped with the second surface of the supporting member in the longitudinal direction.

8. The image heating device according to claim 5, wherein the highly thermal conductive member is a graphite sheet.

9. The image heating device according to claim 5, wherein a width of the highly thermal conductive member in an orthogonal direction of the heater, which is orthogonal to the longitudinal direction, being shorter that a width of the groove portion in the orthogonal direction throughout the longitudinal direction.

* * * * *